US006122803A

United States Patent [19]

Payne

[11] Patent Number: 6,122,803

[45] Date of Patent: Sep. 26, 2000

[54] COTTON GINNING APPARATUS AND METHOD

[75] Inventor: Trevor Payne, Carlton, United Kingdom

[73] Assignee: Templeton Process Developments Limited, Croydon, United Kingdom

[21] Appl. No.: 09/065,025

[22] PCT Filed: May 15, 1997

[86] PCT No.: PCT/GB97/01326

§ 371 Date: Apr. 23, 1998

§ 102(e) Date: Apr. 23, 1998

[87] PCT Pub. No.: WO97/45572

PCT Pub. Date: Dec. 4, 1997

[51] Int. Cl.[7] ..... D01B 1/06

[52] U.S. Cl. ..... 19/53; 19/48 R

[58] Field of Search ..... 19/40, 41, 48 A, 19/48 R, 53, 64.5; 241/7, 9

[56] References Cited

U.S. PATENT DOCUMENTS

| | | | |
|---|---|---|---|
| 388,374 | 5/1888 | Seibert | 19/41 |
| 399,819 | 3/1889 | Baumgarten | 19/41 |
| 3,484,904 | 12/1969 | Berriman et al. . | |
| 4,094,043 | 6/1978 | Vandergriff | 19/53 |

FOREIGN PATENT DOCUMENTS

| | | |
|---|---|---|
| 310847 | 5/1930 | United Kingdom . |
| 1042230 | 9/1966 | United Kingdom . |

*Primary Examiner*—John J. Calvert
*Assistant Examiner*—Gary L. Welch
*Attorney, Agent, or Firm*—Horst M. Kasper

[57] ABSTRACT

A method and apparatus for ginning harvested seed cotton comprising the steps of: introducing harvested seed cotton including lint and seed on to the upper surface of a lower rotating plate (3); rotating said plate to thereby carry said harvested seed cotton towards the leading edge (29) of a knife positioned at a defined distance above said lower rotating plate such that the cotton seed is drawn/combed under the knife edge (27); extracting line separated from said harvested seed cotton from a rearward facing edge of said knife; and collecting said seed from the leading edge of the knife.

19 Claims, 6 Drawing Sheets

COTTON GINNING APPARATUS AND METHOD

This invention relates to an apparatus and a method for ginning cotton. Cotton ginning is the process of separating the cotton lint from the seed after harvesting of the cotton. Generally the ginning is carried out locally to the cotton fields in central ginneries.

Two principal methods of ginning cotton exist being a roller method and a saw method. In the former case the rolled ginned cotton has a horizontal cut which does not damage the staple giving a better product; in the latter case the material is cut vertically which tears and damages the staple but the process is faster. Apparatus presently used varies between small inefficient units using old technology requiring much maintenance and high power input, and high cost comprehensive machinery requiring a volume input to be effective.

In known roller ginning machines, see for example U.S. Pat. No. 4,094,043, a conveyor drops material into hoppers located on top of the gin and feeds material into the gin. The output of each gin is transported; the lint being baled and the seed crushed for oil. The process operates by bringing the cotton into contact with a leather roller to which the fibres adhere and thereafter dragging the cotton past a fixed knife pressed against the roller. A reciprocating knife above the fixed knife separates the lint (fibre) from the seed, the latter dropping through a grid and the lint being stripped away from the leather roller by a rotating bladed stripper.

One of the objects of this invention is to provide a ginning machine for cotton, although use for other products is not excluded, which produces the quality attributed to roller ginning processes but which is of simpler construction and requires less expertise and maintenance in operation. An advantage of the machine of this invention is that higher output may be achieved both in terms of throughput in relation to size and relative to power consumption.

According to this invention, and in one aspect, there is provided a cotton ginning apparatus comprising an upper fixed plate and a lower rotating plate in substantially horizontal parallel superimposed relationship and defining a gap therebetween, the upper (fixed) plate having means to introduce harvested seed cotton including lint and seed fed to the upper surface thereof to the gap between the plates, the upper plate having a number of zones each being provided with a cutting edge forming a knife on the lower surface thereof, the arrangement being such that when cotton is introduced into said gap during relative rotation of the plates and moved past the said cutting edge, lint is progressively severed from the seed, the severed lint (staple) being extracted and the seed being collectable in a separate receptacle.

In a first embodiment the seeds are retained in grooves on the upper surface of the lower plate with slots through the plate.

In a second embodiment the seeds are transported or carried on the lower rotating plate towards the blade affixed to the upper plate and the lint part of the cotton seed is drawn/combed under the affixed blade by a leather/cotton composite pad.

The present invention also provides a method of ginning harvested seed cotton comprising the steps of:

a) introducing harvested seed cotton including lint and seed on to the upper surface of a lower rotating plate;

b) rotating said plate to thereby carry said harvested seed cotton towards the leading edge of a knife positioned at a defined distance above said lower rotating plate such that the cotton seed is drawn/combed under the knife edge;

c) extracting lint separated from said harvested seed cotton from a rearward facing edge of said knife; and d) collecting said seed from the leading edge of the knife.

In order to explain this invention more fully and in greater detail an embodiment is described hereinafter with particular reference to the drawings showing schematically an apparatus by way of example. In the drawings.

Figure 1:
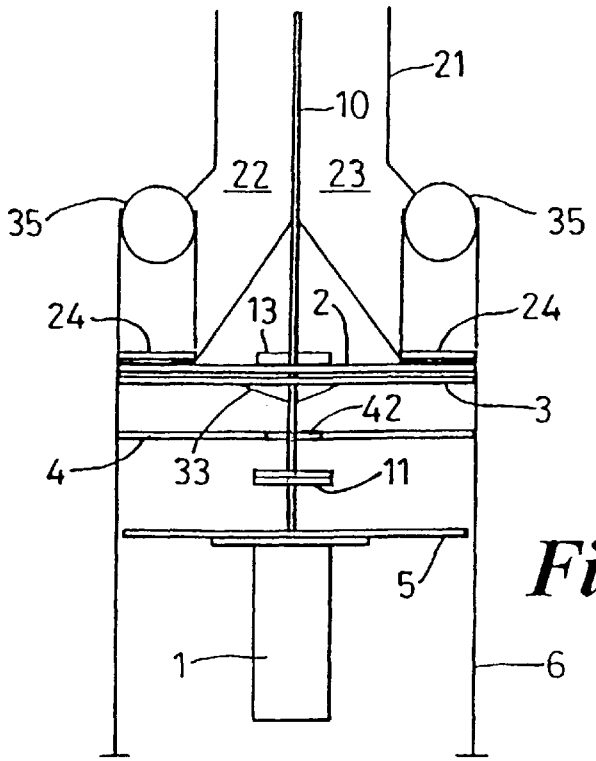
FIG. 1 shows in side elevation and schematically a construction of a first embodiment of a ginning machine according to the present invention.

Referring firstly to FIG. 1 of the drawings a ginning machine according to this invention is shown in side view and schematically. The machine has an electric drive motor 1 mounted on a fixed spyder plate 5 and connected to a drive shaft 10 through a flexible coupling 11. Above the plate 5, which is fixed to frame 6, is positioned a fixed seed collection and discharge plate 4 with aperture 41 to allow the ginned seed to pass through to be collected. Plate 4 has a central aperture 42 to allow the motor drive shaft to pass therethrough.

Located above fixed plate 4 is a rotating plate 3 coupled with shaft 10, this plate is located a defined spaced distance below a fixed feed plate 2. Feed plate 2 has a central aperture 25 supporting a bearing assembly 13 for the shaft 10.

The shaft 10 extends upwardly and may be used to drive the known scarifiers or masticators which are located above the unit.

Figure 2:
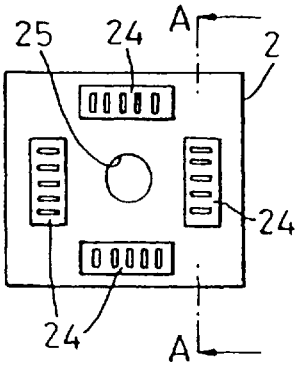
FIG. 2 shows in plan view the feeder plate.

A feed duct assembly 21 for harvested cotton is located above the plate 2 and is generally of a known construction serving to introduce the cotton to be ginned. The duct 21 divides into four branches, two only being shown, 22 and 23. The feed plate 2 has four knife blocks 24 spaced along each side with a central aperture for free passage of shaft 10 (FIG. 2). Each knife block is fed by a branch (22,23) of the duct 21.

Figure 3:
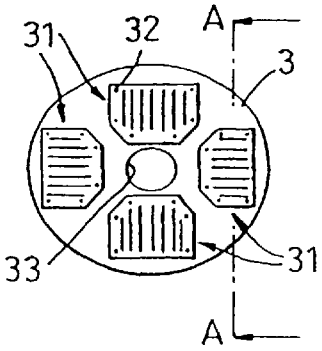
FIG. 3 shows in plan view the rotating plate of one embodiment.
Figure 4:
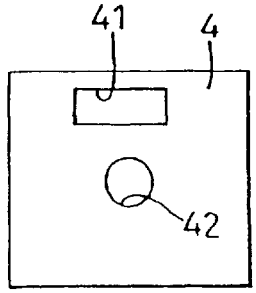
FIG. 4 shows in plan view the seed collection plate.
Figure 5:
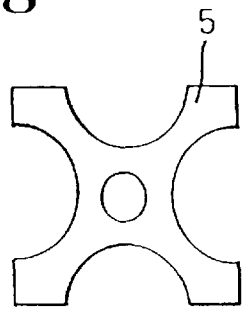
FIG. 5 shows in plan view the motor support plate.
Figure 6:
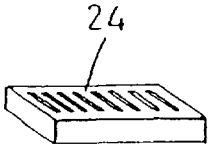
FIG. 6 shows in perspective one knife block.
Figure 7:
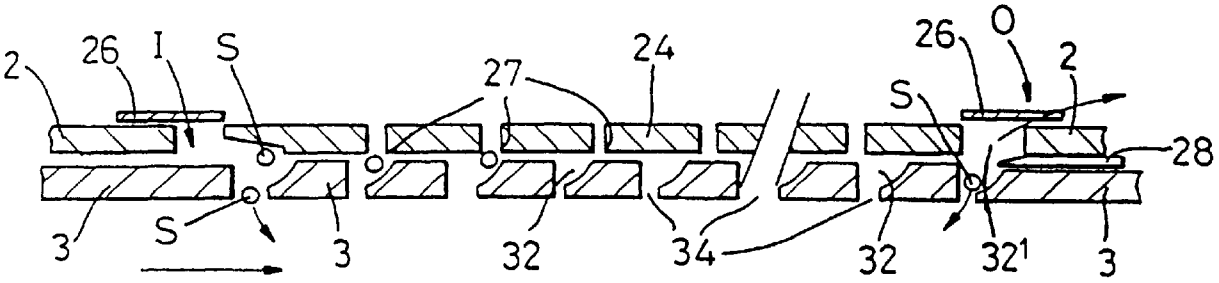
FIG. 7 shows a fragmentary sectional view of the knife block, feeder plate and rotating plate on A—A as shown in FIGS. 2 and 3.

The rotating plate 3 positioned below feed plate 2 has four zones 31 each comprising a series of parallel grooves 32 extending outwardly and a central coupling 33 connected with the drive shaft 10. The grooves 32 lead down to slots 34 passing through the plate (FIG. 7). In FIG. 7 a section is shown on A—A of FIGS. 2 and 3 when the plates 2 and 3 are assembled that is looking towards the centre axis of each plate.

Figure 8:
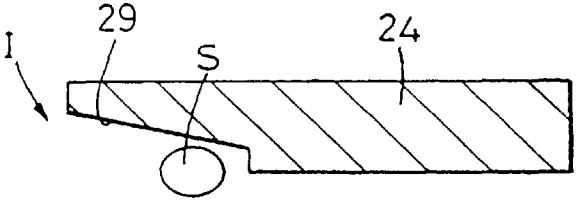
FIG. 8 shows a detail of the knife block edge.

As shown more clearly in FIG. 7, the fixed feeder plate 2 has four apertures each of which receives a knife block 24. Each block is supported by side flanges 26 which rest on the plate surface and which may be shimmed to provide adjustment. The block 24 has slots or is otherwise machined to provide knife-like cutting edges 27. Separate knife blades can be provided mounted on the block. The cotton seed to be ginned S enters the knife block 24 along a side entrance aperture I and is drawn by the rotating plate 3 into the holding channel formed by taper 29 at the leading edge of the knife block 24 (FIG. 8). When the leading edge of the first groove 32' in plate 3 arrives the seed S is drawn in and trapped in the groove and dragged beneath the knife block 24, the seed is dragged upward against the edges 27 through contact with the rotating plates. The cotton lint is thus progressively severed and removed by successive actions of the edges 27. Each succeeding edge turns the seed to present a fresh area of lint which is cut. Stripped seed passes through the slots 34 and a scrapper blade 28 at the outlet end O of the knife block 24 removes any lint on the seed and deflects the lint upwards through an aperture at this end of the block to be drawn away by suction. The blade 28 ensures that the seed is cleanly separated and forced in a downward direction and not dragged out of the grooves to the outlet. The separated seed drops through slots 34 and collects on plate 4 and a sweeper blade or paddle (not shown) on the underside of the plate 3 moves the seed to the aperture 41 in plate 4 for discharge.

The cotton lint separated from the seed in this process and leaving through the outlet O is removed using a known vacuum suction system operating through ducts 35 and feeding a baler (not shown).

In contrast to the known methods of separating the cotton lint from the seed this invention adopts a principle of guiding the cotton between two horizontal and relatively rotating plates, one having a series of cutting edges, and the other having grooves. The lint is severed progressively from the seed which is separated. This surprisingly simple method and construction avoiding leather rollers and other critical parts, has given excellent results and is simple to set-up and adjust as well as requiring relatively little power. As may be appreciated a number of units may be used in parallel according to the volume of cotton to be processed.

In a practical construction the plates are about 1 m in diameter and 19 mm thick with the knife blocks 24 and grooved areas 32 being some 330 mm long and 280 mm wide. The knife block preferably has five cutting edges or separate blades but this number is variable. The gap between the plates 2 and 3 is set accurately by trials which can be easily carried out and fine adjustment can be provided by shims on the knife blades under flanges.

Figure 9:
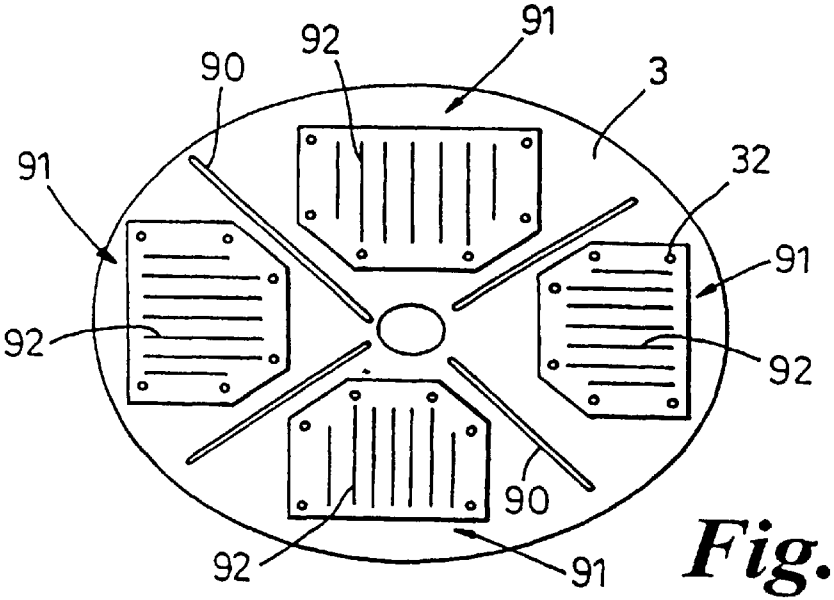
FIG. 9 shows a modified construction of a rotating plate.

In FIG. 9 a modification is disclosed for the rotating plate 3 and in this construction possible distortions in the plate are avoided by providing a cast iron plate 3 with webs 90 on the underside and four cut-out apertures 91 in the plate which support grooved and slotted steel plate assemblies 92. The slots 32,34 may be provided between individual bars on these plates 92 which can be adjusted in spacing to provide optimum performance. In this construction the grooved zones 32, 24 on plate 3 are formed by separate sub-assemblies 92 such as sheet metal units.

In a modification the edge of the knife block 24 adjacent the cutting edge 27 may be chamfered.

In an example harvested cotton which has had all field debris (stones and twigs mainly) screened out and has been broken up in a scarifier or masticator, is fed through the end of one of the four knife blocks 24 of plate 2. The material entering the gap between plates 2 and 3 through the end of one of the four knife blocks 24 is fed into a groove in the rotating plate and carried under the knife block where the knife edges remove the lint from the seed. The lint then passes over the scraper knife at the end of the knife block which guides it out of the exit at the other end of the knife block from where it first entered. At the same time as the lint passes over the scraper knife the seed with any remaining lint passes under the scraper knife and the scraper knife removes any final bits of lint remaining. The seed is now free to drop through the groove and any remaining lint is carried onto the next knife block and exits with the lint entering at that knife block which displaces the seed.

The lint which has exited from the side of the knife block in plate 2 is taken away by a vacuum process which conveys the material to the baler.

The seed which is left behind falls into the groove 32 in the rotor 3 and passes through to plate 4. A paddle or flange on the underside of plate 3 sweeps the seed towards an exit hole where it falls through to a collection area for bagging.

Figure 10:
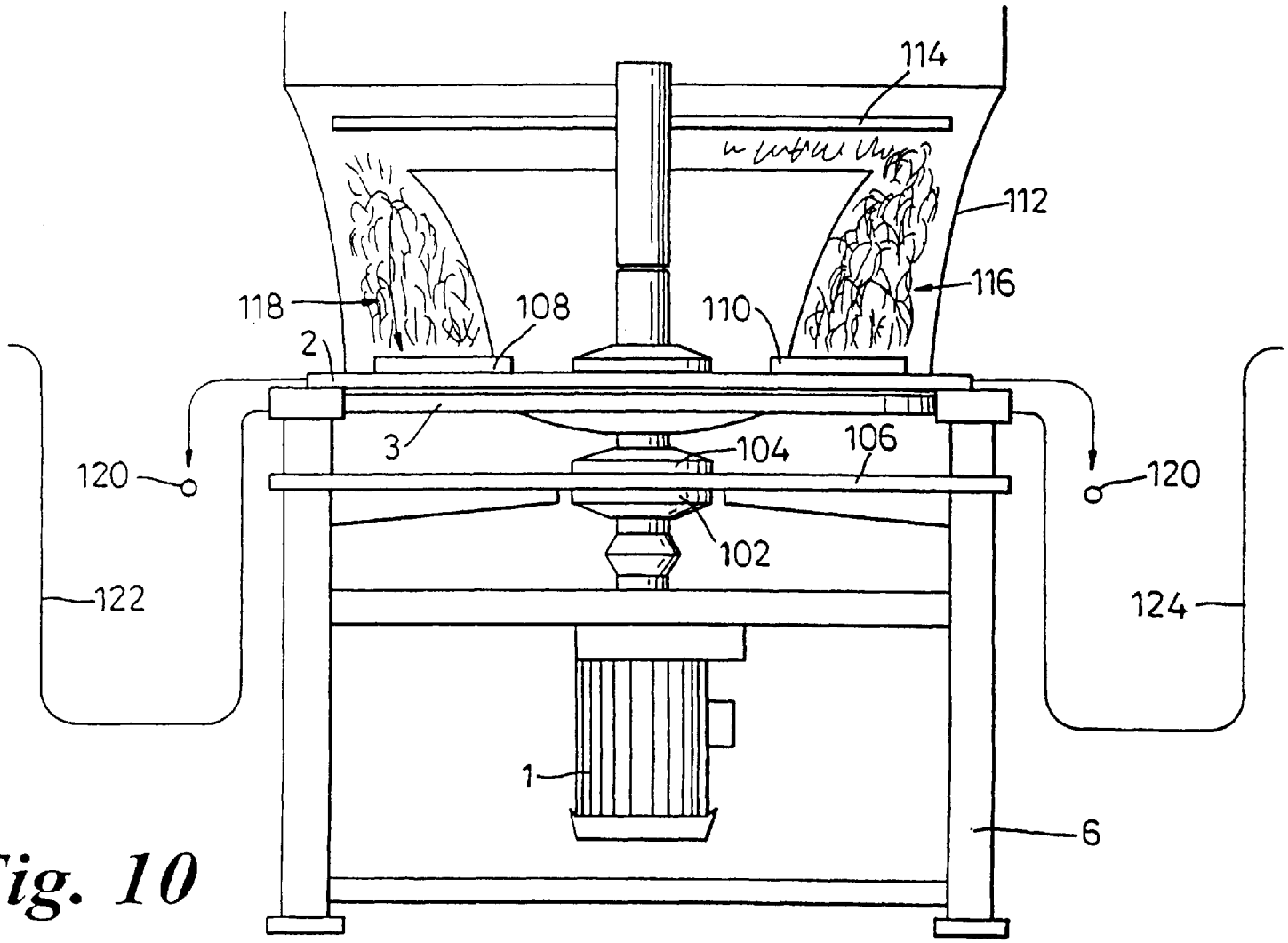
FIG. 10 shows a second embodiment of a ginning apparatus according to the present invention.

A second embodiment is shown in FIG. 10 in which similar parts to FIG. 1 are given the same reference numerals. The flexible bearing of FIG. 1 is replaced by a twin bearing structure 102, 104 positioned each side of an intermediate plate 106. This arrangement relieves stress on the motor 1. The motor 1 may be 6 to 10 horse power. The 6 HP motor is preferred for a rotor size of 1 meter (40 inches) and the 10 HP for a rotor diameter of 1.5 meters (60 inches).

The upper blade 2 has revised blade holder structures 108, 110. There may preferably be 2, 4 or 8 such structures.

A feed hopper 112 is mounted above blade 2 and is provided in a preferred embodiment with a rotating strimmer 114. Feed chutes 116, 118 feed the seed cotton down to the blade structure.

The seeds 120, once stripped of their cotton lint are collected in bags 122, 124 and are ejected from the rotating plates 2, 3 by a compressed air jet as explained with reference to FIGS. 12 and 13. The compressed air and a vacuum for the apparatus may be supplied by known suitable means.

Figure 11:
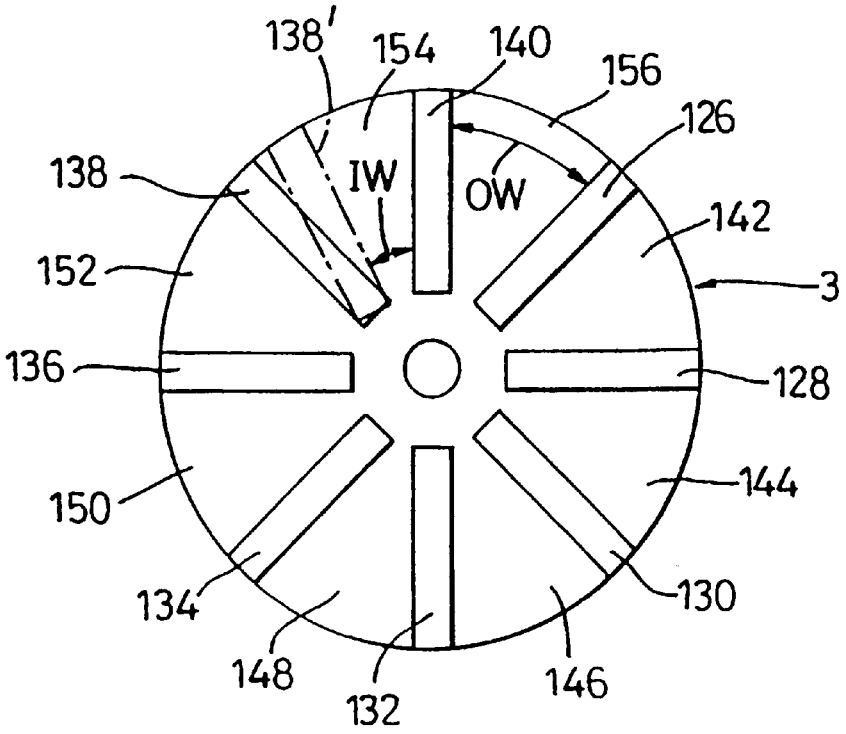
FIG. 11 shows an alternative design of rotor.
Figure 14:
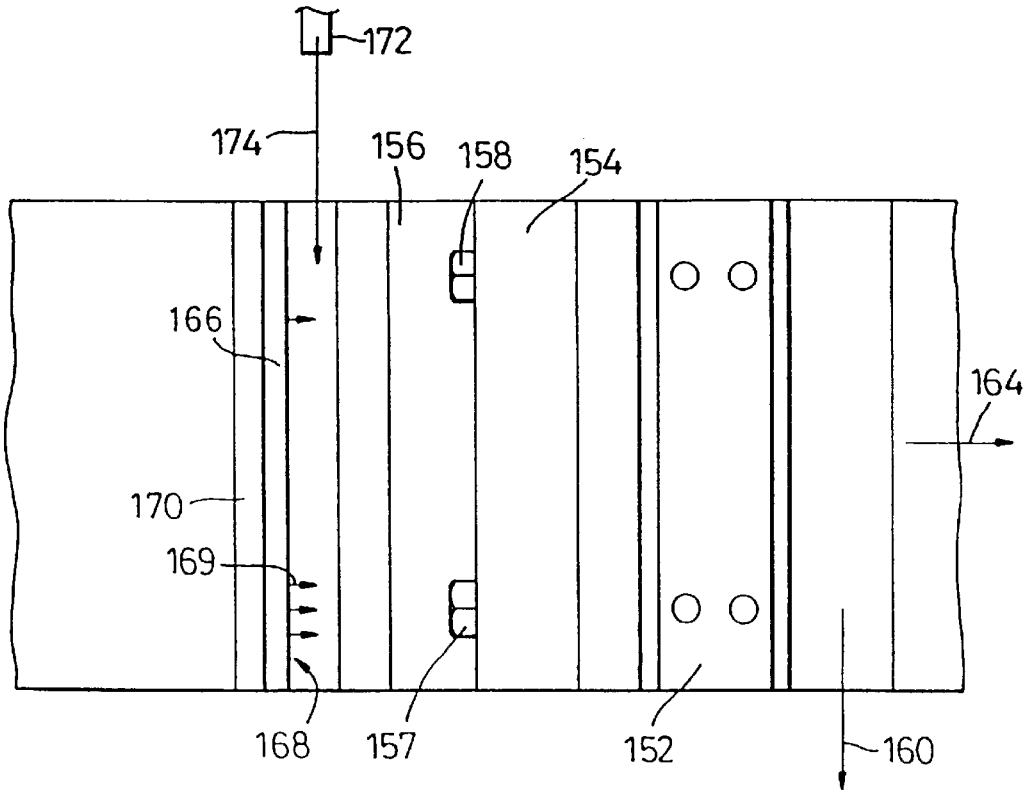
FIG. 14 shows in plan view the lower blade surface.

With reference now to FIG. 11, a new design of rotor 3 is diagrammatically shown. The rotor 3 preferably comprises a cast iron plate which has mounted on it a plurality of rotating blades 126–140. Between each blade 126, 128 etc is a sheet of leather or cotton composite or other suitable materials which preferably have no adverse effect to further processing such as dyeing 142–156 which acts to grip the cotton and as the blade 3 rotates to drive it on to the fixed blade, as shown in FIG. 12. The leather sheets will be substantially triangular in shape with an inner width (IW) of 3–4 inches and an outer width (OW) of 8–10 inches. This is desirable because the cotton is moved by the friction on the leather or cotton composite and the inner rotor moves at a correspondingly lower speed thereby providing more friction grip which requires less leather. The upper plate surface will be substantially flat with the leather and blades forming the flat surface. In FIG. 14 an alternative design of leather mounting is shown but in FIG. 11 the leather is glued or otherwise affixed rigidly to the upper plate in the gaps formed by the blades 126–140.

In a further embodiment the blades 126–138 may be set at a different angle as shown by the dotted lines 138'. This arrangement is such that the rotating blades 126–138 meet with the fixed blades at an angle rather than square on and produce more or a scissor action.

Figure 12:
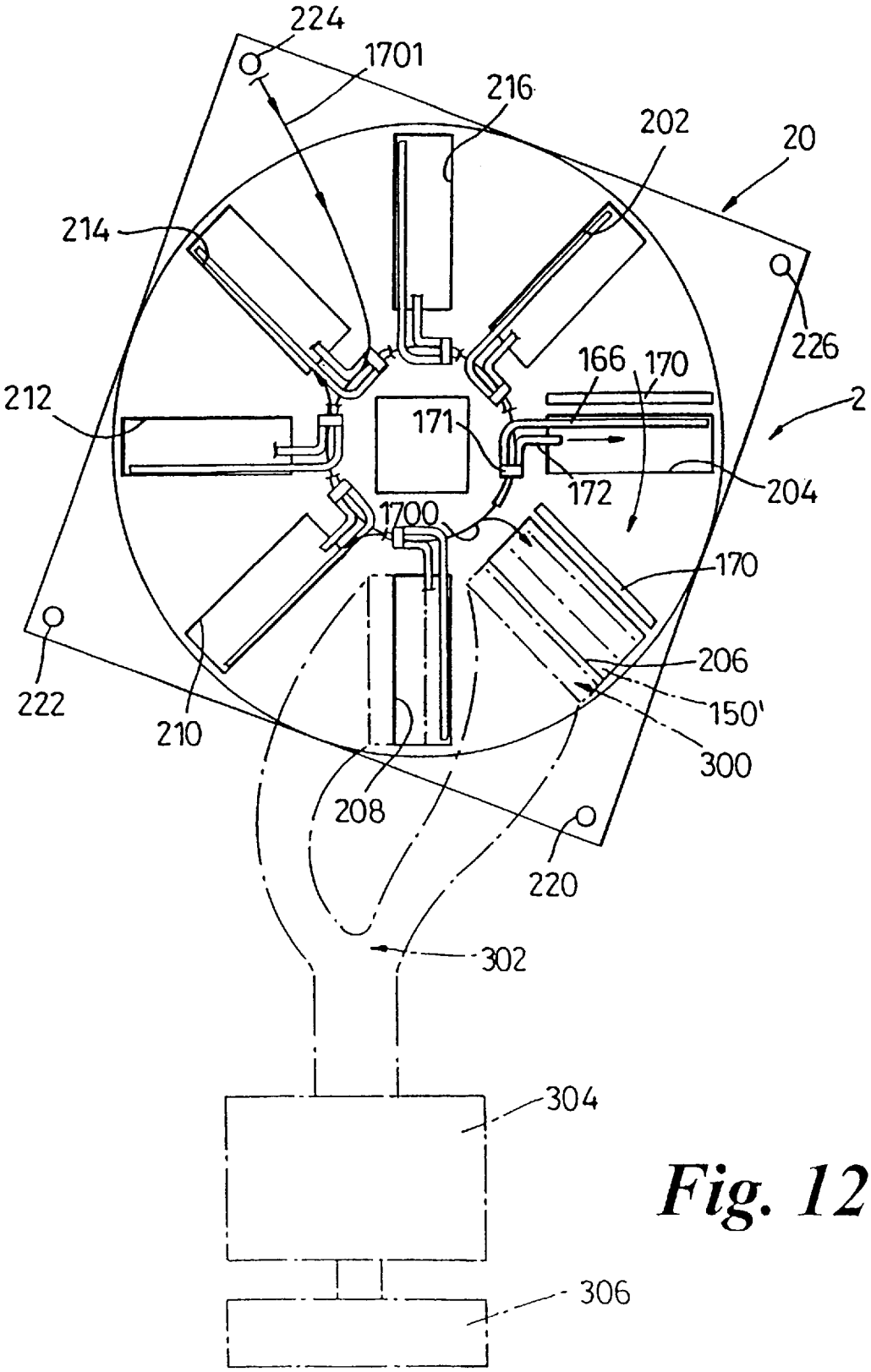
FIG. 12 shows an alternative design of upper plate.

The upper fixed plate structure 2 shown in FIG. 12 comprises in a preferred embodiment a square plate 20 with rectangular apertures 202, 204 . . . 216 cut through the upper plate. The plate may be, for example, ½ inch steel plate and may be provided with fixing holes 220 to 226 for fixing the plate to the frame 6 (FIG. 1). Adjacent to each aperture 202 to 216 is a blade arrangement 150 as shown in greater detail in FIGS. 13 and 14. Assuming a direction of rotation of the bottom plate as shown by the arrow, the blade structures 150 are positioned as shown in dotted outline 150' by each aperture. The dimensions of the apertures for a 1.5 meter rotor are in a preferred embodiment 220 mm wide by 417 mm long. Although shown equispaced, the position of the apertures may have to be slightly adjusted to ensure that the corner fixing holes 220 to 226 do not interfere with the seed ejection or vacuum extraction apparatus 300 shown dotted in FIG. 12.

Obviously for a plurality of aperture/blade arrangements a manifold vacuum arrangement 302 will be required to feed to a lint collection apparatus 304 and vacuum pump 306. These are shown dotted and the manifold 302 is illustrated for only two apertures but could readily be modified to exhaust all eight apertures or a plurality of vacuum apparatuses could be used.

In FIG. 12 the air pipe 172 is shown associated with aperture 204 which provides the air to jet 174 (see FIG. 14) to blow the seeds into the receptacles.

This air pipe 172 may in a preferred embodiment be fed from a manifold 171 which also provides air for pipe 166. The manifold may be connected to a ring manifold structure 1700 and fed by compressed air through inlet pipe 1701 which is preferably fed out near a fixing hole corner 224 of the upper plate.

Figure 13:
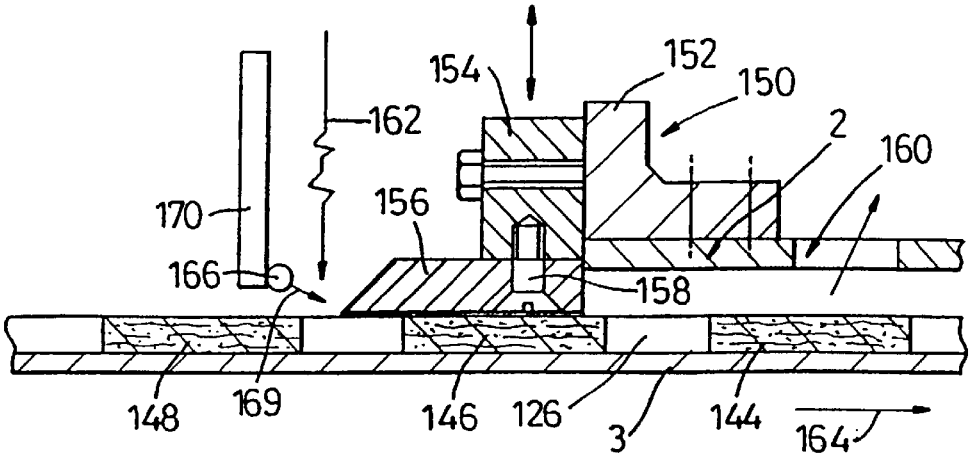
FIG. 13 shows in side elevation the blade arrangement of the apparatus of FIG. 10.

With reference now to FIGS. 13 and 14, each upper blade structure 150 comprise support block 152 attached to support plate 2, a blade support block 154 attached to block 152 and an upper blade 156. Upper blade 156 is adjustable using bolts 157, 158 (only one shown in FIG. 12).

Lint cut from the cotton is output via outlet 160 and is vacuum sucked out by vacuum means (not shown).

The inlet harvested seed cotton, including the seed and lint and possibly other impurities such as parts of leaves, is dropped on to plate 3 as indicated by arrows 162. Plate 3 rotates in the direction indicated by arrow 164. Leather or cotton composite pads 144 etc "pick up" the harvested seed cotton and carry or transport it towards the blade 156. The lint part of the seed cotton is then drawn/combed under the fixed blade and the cutting action of the fixed blade and the rotating blade which are affixed to the rotor alongside the leather pads sever the lint from the seed. Cut lint passes between blade 156 and plate 3 and is vacuumed out at 160 to vacuum apparatus 300–306. To assist in the cotton seed being forced against blade 156 an air jet or jets is provided by a pipe 166 which has small holes 168 (FIG. 13) to direct the jet as indicated by arrow 169. Air pipe 166 may be attached to a guide plate 170 which guides the cotton seed.

The seed 120, once stripped of the cotton lint are ejected by means of a further air flow 174 provided by a pipe 172. This projects the seed into bags 122–124 etc.

Figure 15:
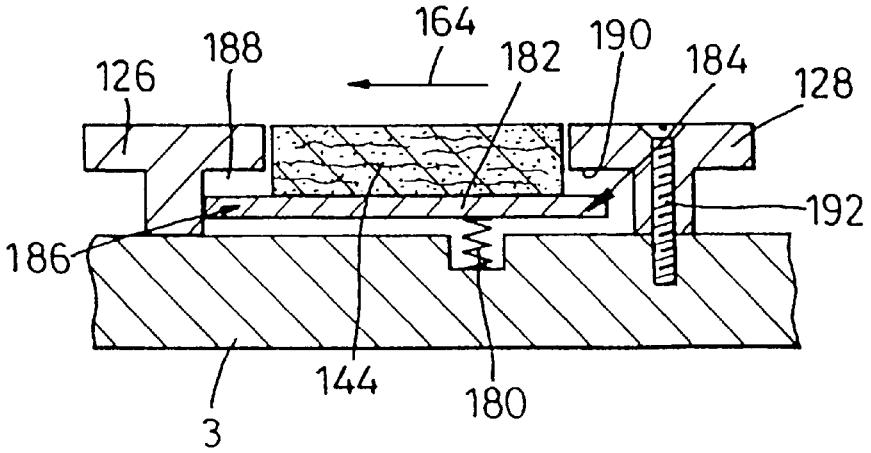
FIG. 15 shows in side elevation an alternative lower blade structure.

In an alternative arrangement for the lower plate 3 shown in FIG. 15, the leather or cotton composite pads 144 etc may be arranged to be spring loaded so that as the pad wears, the wear will be taken up by the action of springs 180. To mount the leather pad, a steel plate 182 may be used which plate may be elongated at 184 to catch under an overhang 190 in each blade 128. The hinge at the other end may be provided by any simple means such as a further extension 186 to plate 182 fixing under the adjacent blade 126 in a recess 188.

As the leather pad wears, so the spring 180 will push the leather upwards, thereby ensuring good frictional contact with the cotton seed. In this embodiment the lower blades 126 etc are freed to the plate 3 by suitable screws 192. The gap between upper and lower knife edges is in a preferred embodiment between 2 to 6 thousandths of an inch.

In a further embodiment for certain types of harvested seed cotton it may not be necessary to have any blades on the rotating plate. The upper surface of the plate will be leather on a cotton composite which will by its rotary action throw the harvested seed cotton against the upper fixed blades thereby stripping the lint from the seed. The lint will pass under the fixed blade to be vacuum extracted as described above.

Each fixed blade has a feed chute (116, 118 etc) associated with it. If the diameter of the rotor is increased for example to 2 meters diameter then the number of blades and therefore feed chutes can be increased to for example twelve or more.

I claim:

1. A cotton ginning apparatus including an upper fixed plate and a lower rotating plate in substantially horizontal parallel superimposed relationship and defining a gap therebetween, the upper fixed plate having means to introduce harvested seed cotton including lint and seed fed to the upper surface thereof to the gap between the plates, the upper plate having a number of zones each being provided with a cutting edge forming a knife on the lower surface thereof, the arrangement being such that when cotton is introduced into said gap during relative rotation of the plates and moved past the said cutting edge, lint is progressively severed from the seed, the severed lint being extracted and the seed being collectible in a separate receptacle.

2. A cotton ginning apparatus as claimed in claim 1 in which the lower rotating plate comprises a series of zones, each zone including a cutting blade for cooperation with the knives on the upper plate.

3. A cotton ginning apparatus as claimed in claim 2 in which the lower plate comprises a plurality of blades each co-operating with said upper knife edges to form a plurality of scissor arrangements, the upper and lower knife edges being separated by a defined gap;

a lower opening in the lower rotating plate for removal of seeds, from where the seed is collected into a separate receptacle.

4. A cotton ginning apparatus as claimed in claim 3 in which the defined gap is between 2 to 6 thousandths of an inch.

5. A cotton ginning apparatus as claimed in claim 3 in which the plurality of blades in the lower plate are separated by a plurality of cotton composite pads fixed between each blade, each cotton composite pad serving to drive the lint part of the harvested seed cotton on to each upper knife blade to be separated from the seed.

6. A cotton ginning apparatus as claimed in claim 1 further comprising guide plate means proximate to each upper plate knife edge for guiding the harvested cotton to an area of the upper fixed plate outside of the axis of the upper fixed plate.

7. A cotton gin apparatus as claimed in claim 1 further comprising vacuum suction means situated at the rearward edge of said upper blade means for extracting the lint cut by said upper blade means.

8. A cotton ginning apparatus comprising an upper fixed plate and a lower rotating plate in substantially horizontal parallel superimposed relationship and defining a gap therebetween, the upper fixed plate having means to introduce harvested seed cotton including lint and seed fed to the upper surface thereof to the gap between the plates, the upper plate having a number of zones each being provided with a cutting edge forming a knife on the lower surface thereof, the arrangement being such that when cotton is introduced into said gap during relative rotation of the plates and moved past the said cutting edge, lint is progressively severed from the seed, the severed lint being extracted and the seed being collectible in a separate receptacle;

guide plate means proximate to each upper plate knife edge for guiding the harvested cotton;

compressed air jet means attached to said guide plate, said jet means being directed towards the leading edge of the upper knife blade.

9. A cotton ginning apparatus comprising an upper fixed plate and a lower rotating plate in substantially horizontal parallel superimposed relationship and defining a gap therebetween, the upper fixed plate having means to introduce harvested seed cotton including lint and seed fed to the upper surface thereof to the gap between the plates, the upper plate having a number of zones each being provided with a cutting edge forming a knife on the lower surface thereof, the arrangement being such that when cotton is introduced into said gap during relative rotation of the plates and moved past the said cutting edge, lint is progressively severed from the seed, the severed lint being extracted and the seed being collectible in a separate receptacle;

wherein the lower rotating plate comprises a series of zones, each zone including a cutting blade for cooperation with the knives on the upper plate;

wherein the lower plate comprises a plurality of blades each co-operating with said upper knife edges to form a plurality of scissor arrangements, the upper and lower knife edges being separated by a defined gap;

wherein the plurality of blades in the lower plate are separated by a plurality of leather pads fixed between each blade, each leather pad serving to drive the lint part of the harvested seed cotton on to each upper knife blade to be separated from the seed.

10. A method of ginning harvested cotton seed comprising the steps of:

a) introducing harvested seed cotton including lint and seed on to the upper surface of a lower rotating plate;

b) rotating said plate to thereby carry said harvested seed cotton towards the leading edge of a knife positioned at a defined distance above said lower rotating plate such that the cotton seed is drawn/combed under the knife edge;

c) extracting lint separated from said harvested seed cotton from a rearward facing edge of said knife; and d) collecting said seed from the leading edge of the knife.

11. A method of ginning harvested seed cotton as claimed 10, comprising the step of:

introducing harvested seed cotton at a plurality of locations on to the rotating plate for cooperation with a plurality of knife edges.

12. A method of ginning harvested seed cotton as claimed in claim 10 further comprising the step of extracting the lint by a vacuum process via a manifold system from a rearward facing edge of said knife.

13. A cotton ginning apparatus comprising an upper fixed plate;

a lower rotating plate, wherein the upper plate is disposed in a substantially horizontal parallel superimposed relationship relative to the lower plate and wherein the upper fixed plate and the lower rotating plate define a gap there between;

passing means disposed at the upper fixed plate for passing harvested seed cotton including lint and seed fed to an upper surface of the upper fixed plate to the gap between the upper fixed plate and the lower rotating plate;

a plurality of cutting edges forming knifes on the lower surface of the upper fixed plate, wherein each cutting edge is associated with a respective zone of the upper fixed plate, wherein when cotton is introduced into said gap during relative rotation of the lower rotating plate and when cotton is moved past one of said cutting edges, lint is progressively severed from the seed;

an upper opening in the upper fixed plate for removal of lint, from where the severed lint is extracted;

a lower opening in the lower rotating plate for removal of seeds, from where the seed is collected into a separate receptacle.

14. A cotton ginning apparatus having means to introduce harvested seed cotton, including lint and seed, to a surface having a zone provided with a cutting edge forming a knife, a gap being provided between the surface and the knife, the arrangement being such that when cotton is introduced into said gap during relative rotation of the surface and moved past the said cutting edge, lint is progressively severed from the seed, the severed lint being extracted and the seed being collected, characterized in that;

the apparatus includes an upper fixed plate (2) and a lower rotating plate (3) in substantial horizontal parallel superimposed relationship defining the said gap therebetween, means (21) being provided to feed the harvested seed cotton (S) including the lint and seed to the upper surface of the fixed plate (2) and to the gap provided between the plates (2, 3), the upper plate (2) having a number of zones (24) each being provided on the lower surface thereof with a cutting edge (27) forming the knife.

15. A cotton ginning apparatus as claimed in claim 14, characterized in that the lower rotating plate (3) comprises a series of zones (31), each zone including a cutting blade (32) for co-operation with the knives (27) on the upper plate (2);

guide plate means (26, 170) are proximate to each upper plate knife edge (27) for guiding the harvested cotton (S); and compressed air jet means (172) are attached to said guide plate (170), said jet means being directed towards the leading edge (29, 156) of the upper knife block (24, 160).

16. A cotton ginning apparatus as claimed in claim 14, characterized in that, vacuum suction means (35, 300–306) are situated at the rearward edge of said upper blade means (24, 150) for extracting the lint cut by said upper blade means;

wherein the lower plate (3) comprises a plurality of blades (32, 126–140) each cooperating with said upper knife edges (27) to form a plurality of scissors arrangements, the upper and tower knife edges being separated by a defined gap; and wherein the defined gap is 0.05 to 0.15 mm.

17. A cotton ginning apparatus as claimed in claim 14, characterized in that, the plurality of blades (32, 126–140) in the lower plate (3) are separated by a plurality of leather or cotton composite pads (44) fixed between each blade, each leather or cotton composite pad serving to drive the lint part of the harvested seed cotton on to each upper knife blade to be separated from the seed.

18. A method of processing harvested cotton in order to separate the seed from the lint, which method comprises:

a) introducing harvested cotton including lint and seed on to a surface;

b) moving the surface to thereby carry said harvested seed cotton towards the leading edge of a knife positioned at a defined distance above said surface, such that the seed cotton is drawn/combed under the knife edge;

c) extracting lint separated from said harvested seed cotton from a rearward facing edge of said knife;

d) collecting said seed from the leading edge of the knife; characterized in that:

e) the harvested seed cotton including the lint and seed is fed to the upper surface of a rotating plate forming the rotating surface, the knife being positioned above said rotating plate.

19. A method of processing harvested cotton as claimed in claim 18, characterized by the further step of introducing harvested cotton at a plurality of locations on to the rotating plate for cooperation with a plurality of knife edges; and by the further step of extracting the lint by a vacuum process via a manifold system.

* * * * *